United States Patent [19]

Focke et al.

[11] Patent Number: 4,819,343

[45] Date of Patent: Apr. 11, 1989

[54] APPARATUS FOR THE STORAGE OF (CIGARETTE) PACKS

[75] Inventors: Heinz Focke, Verden; Hans J. Bretthauer, Bremen, both of Fed. Rep. of Germany

[73] Assignee: Focke & Co. (GmbH & Co.), Verden, Fed. Rep. of Germany

[21] Appl. No.: 11,486

[22] Filed: Feb. 5, 1987

[30] Foreign Application Priority Data

Feb. 19, 1986 [DE] Fed. Rep. of Germany ..... 3605177

[51] Int. Cl.[4] ..... F26B 11/00

[52] U.S. Cl. ..... 34/187; 34/186

[58] Field of Search ..... 34/186, 188, 187, 21

[56] References Cited

U.S. PATENT DOCUMENTS 2,927,782 3/1960 Paton ..... 34/187

FOREIGN PATENT DOCUMENTS 3400650 7/1985 Fed. Rep. of Germany ..... 34/187

*Primary Examiner*—Henry A. Bennet

*Attorney, Agent, or Firm*—Sughrue, Mion, Zinn, Macpeak, and Seas

[57] ABSTRACT

In the course of a process carried out on a packaging machine for (cigarette) packs, it is necessary for glue spots to set. For this purpose, there is a drying turret (20) which is equipped with a plurality of sawtooth-shaped pockets (27) directed approximately radially. These form chambers (31) which are arranged offset relative to one another and which are each intended for receiving a pack (21). It is thereby possible to handle effectively even only partially filled pockets (27).

21 Claims, 13 Drawing Sheets

APPARATUS FOR THE STORAGE OF (CIGARETTE) PACKS

DESCRIPTION

Figure 1:
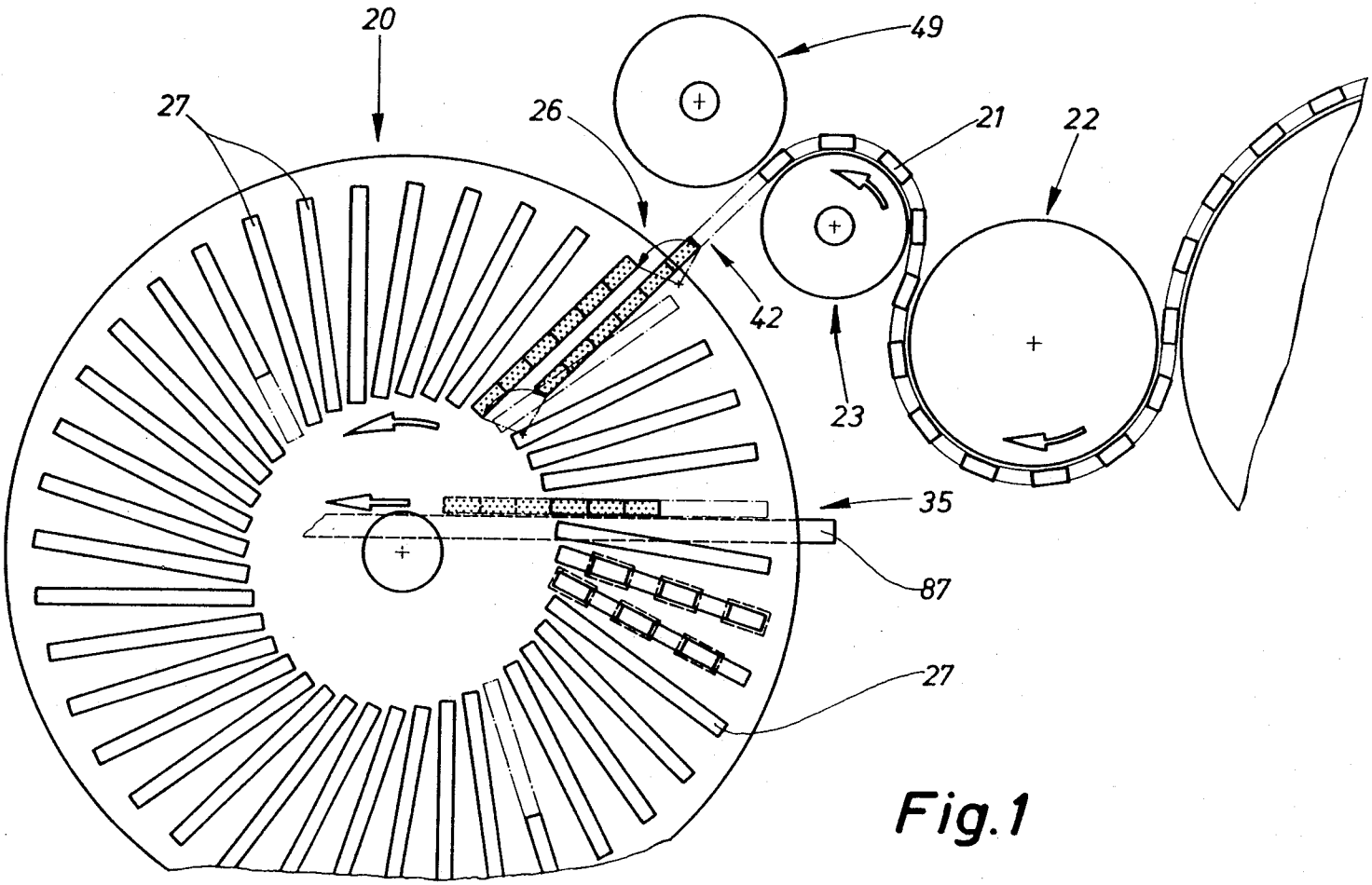

The invention relates to an apparatus for the storage of (cigarette) packs, especially for the setting of glue soots, with a rotating (drying) turret which has receptacles (pockets) distributed along the periphery and each intended for a plurality of packs.

In the production of packs for cigarettes and other articles to be packaged, folding tabs of blanks forming the packs have to be glued together. Because of the high work speed of the packaging machines, special measures have to be taken to give the cigarettes a sufficient dwell time during the packaging process to allow glue spots to set. Turrets (drying turrets) for temporarily receiving the packs after the folding tabs have been glued together are known for this purpose.

Drying turrets should be designed so that they have a high capacity, guarantee easy, rapid insertion and extraction of the packs and furthermore not impair the production flow of the packaging machine.

The invention is concerned with an apparatus of the type mentioned in the introduction, the drying turret, as an integral part of this apparatus, having the properties mentioned above. The object on which the invention is based is to increase further the efficiency, in particular the capacity of the drying turret, improve the handling operations, especially the feeding and emptying of packs and in particular compensate faults arising during the delivery of packs.

To achieve this object, the apparatus according to the invention is characterized in that the pockets of the drying turret are directed (approximately) radially and in the longitudinal direction of the pockets have subdivisions for supporting each pack.

According to a further feature of the invention, the individual packs are supported in the pockets of the drying turret as a result of a stepped design of side walls of the pockets, specifically in such a way that the packs within the pockets are each supported on an adjacent pack and, when a pack is missing in the adjacent chamber, on a pocket offset. As a result, the drying turret can be operated uniformly and continuously, irrespective of any interruptions in the delivery of the packs. Any gaps in the conveyance of the packs mean that the pockets are not filled completely but do not result in any change in the predetermined relative position of the packs.

A further special feature of the invention is the feeding and emptying of the pockets of the drying turret. During feeding, in the region of a filling station a number of packs corresponding to the capacity of the pocket or to the number of chambers is conveyed into a position adjacent to a pocket and aligned respectively with the chambers of the latter. The particular group of packs is pushed into the pocket as a result of a joint transverse movement (in an approximately axis-parallel direction). Likewise, after a part rotation of the drying turret the group of packs which are now set is conveyed out of the pockets as a result of transverse or axis-parallel displacement. The latter are therefore laterally open.

In the region of the feed station, the packs assigned to a particular pocket are collected on a pack platform. This is equipped with a number of stages which are adjustable, in particular are pivotable in a staggered manner and which are each intended for receiving a pack, this number corresponding to the number of packs of a pocket. As a result of the relative adjustment of the individual stages, these, together with the packs, are brought into a staggered position which ensures that each pack is aligned exactly with an associated chamber of the pocket. The group of packs can now be fitted into the pocket in the offset relative position.

Further features of the invention relate to the design of the drying turret and of the members and units for delivering the packs to the drying turret and for emptying the pockets of the latter.

Figure 2:
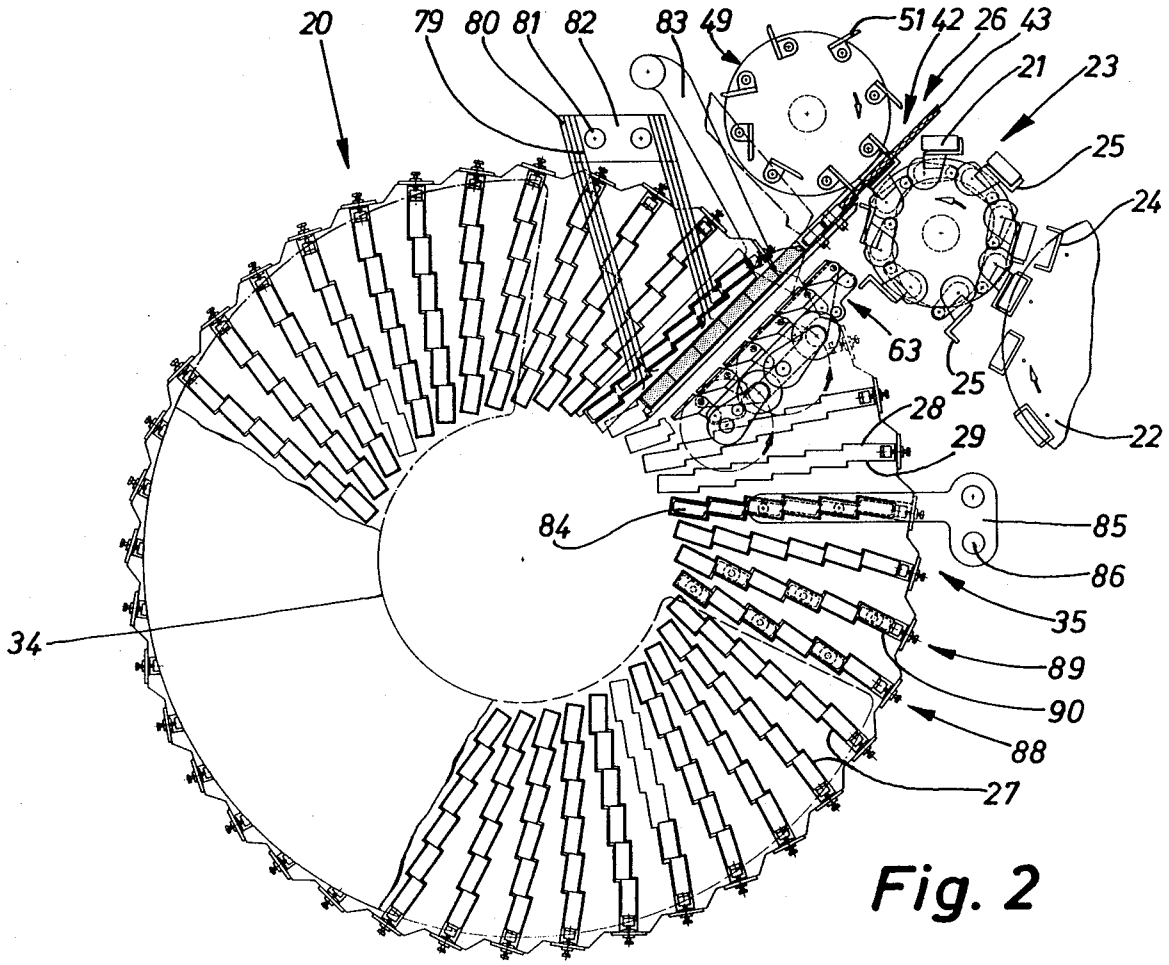
Figure 3:
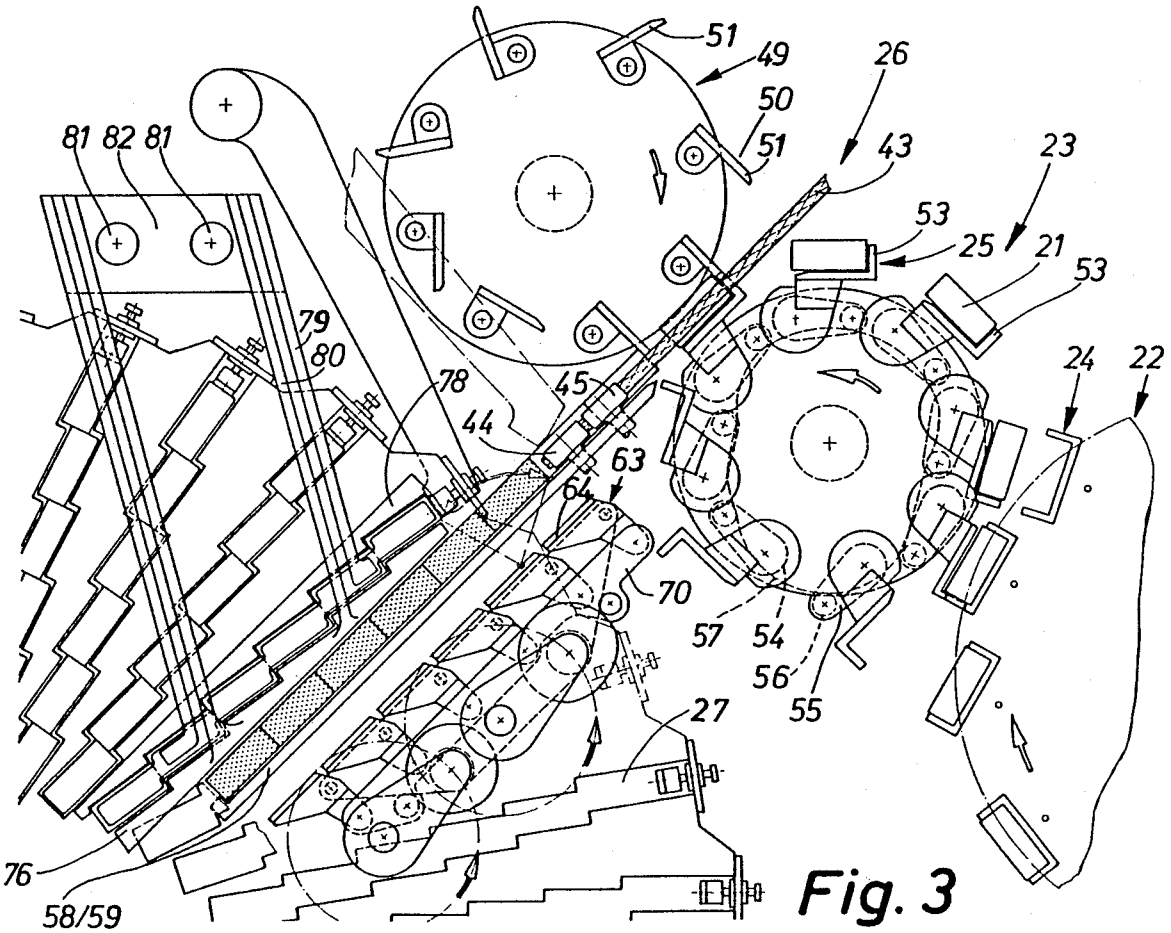
Figure 4:
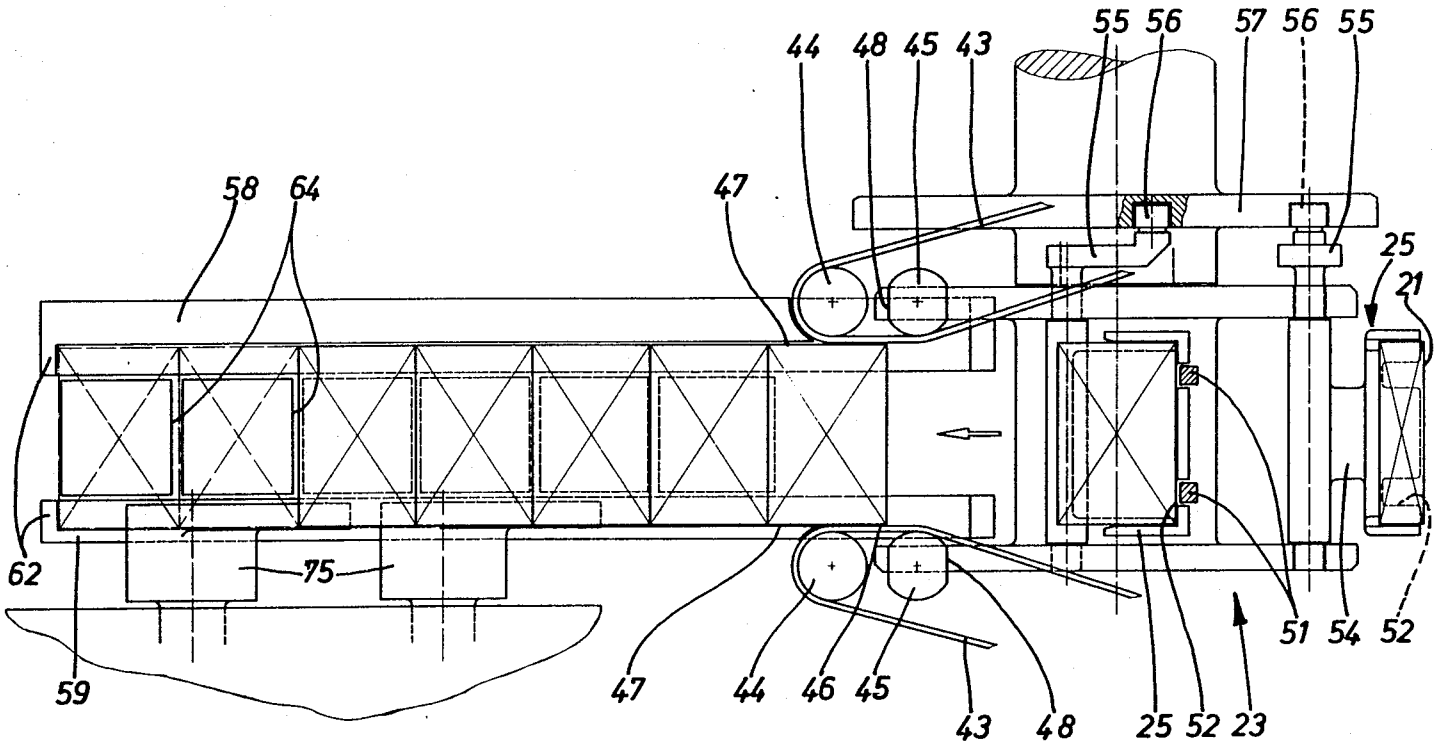
Figure 5:
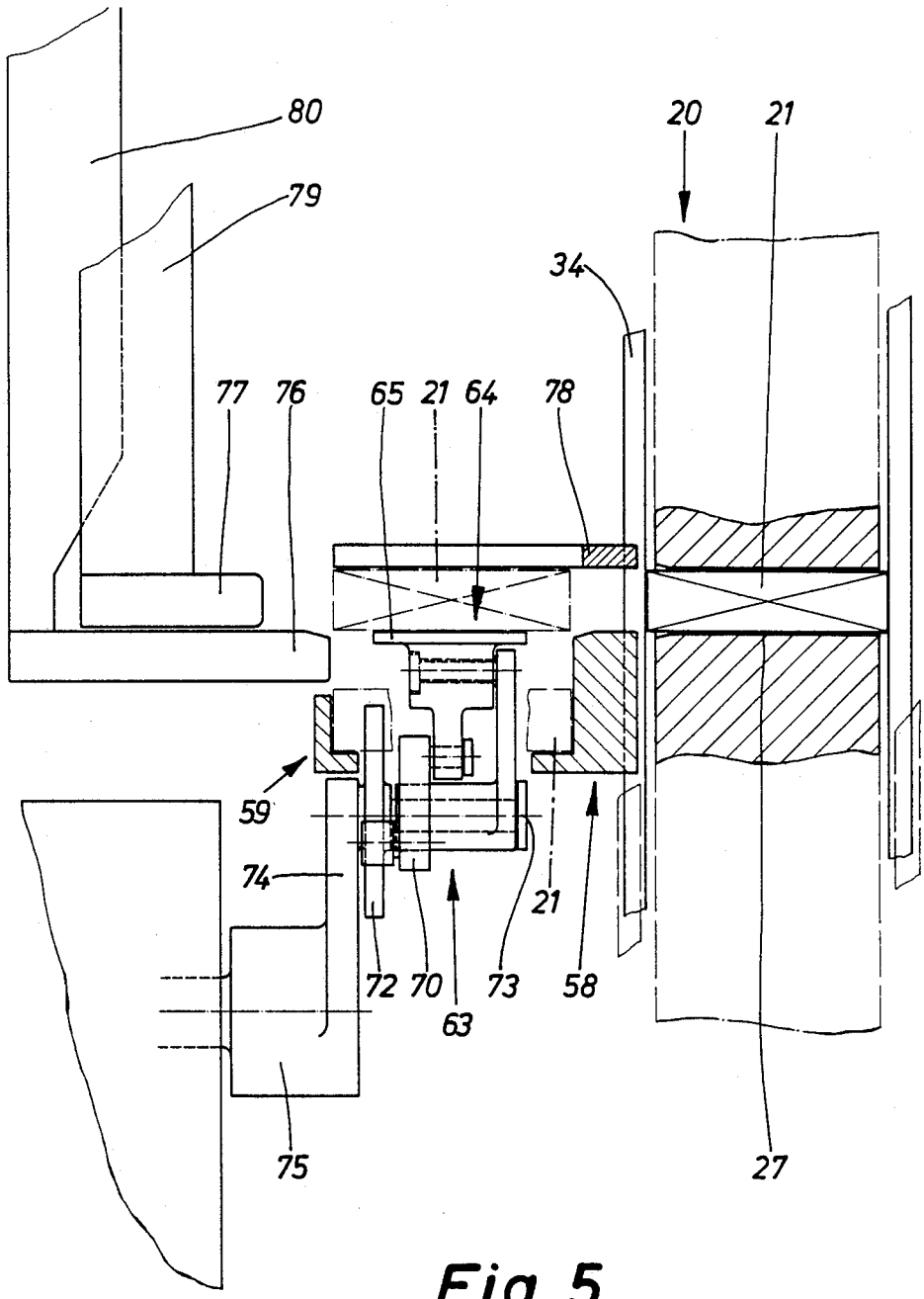
Figure 6:
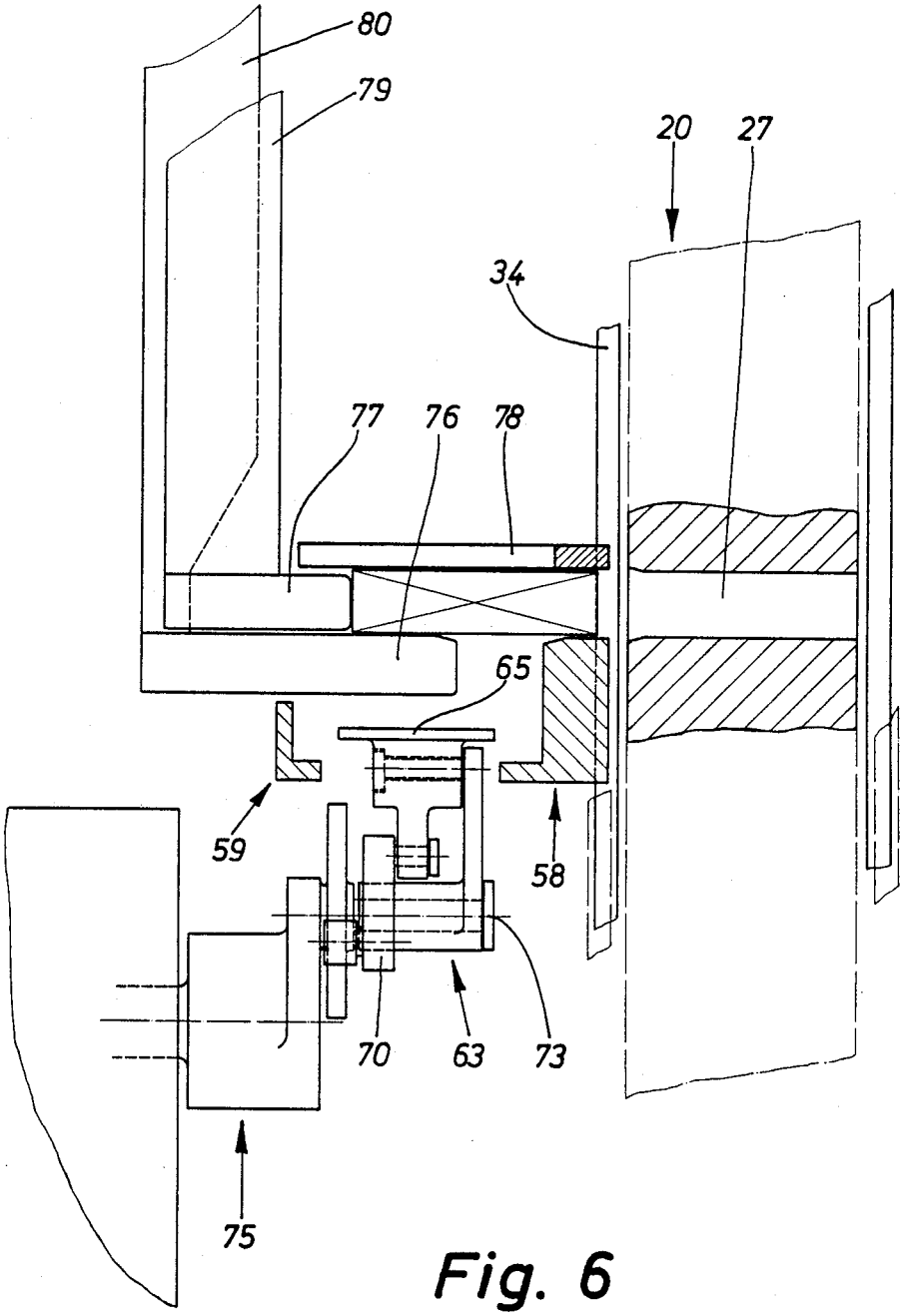
Figure 7:
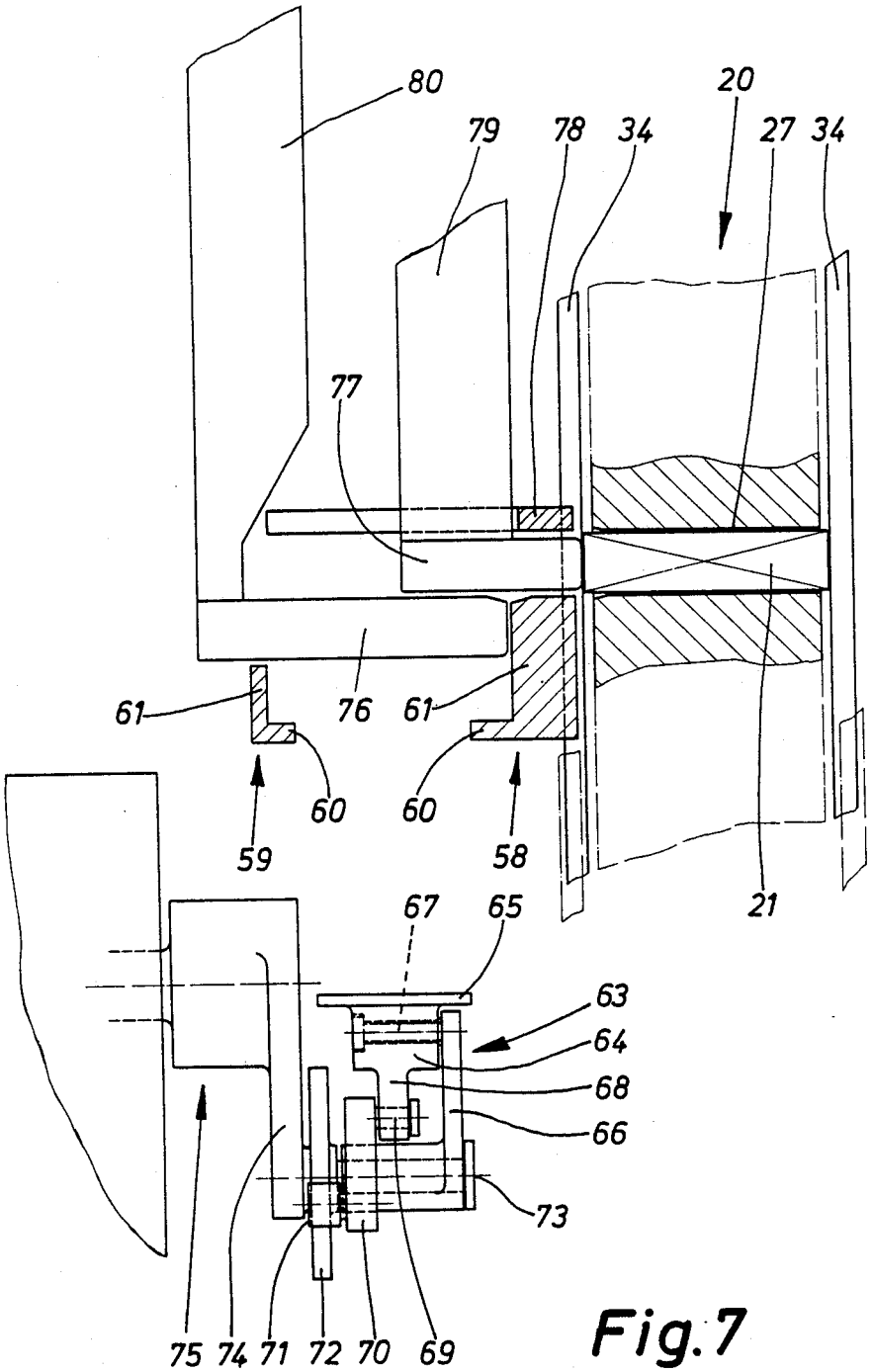
Figure 8:
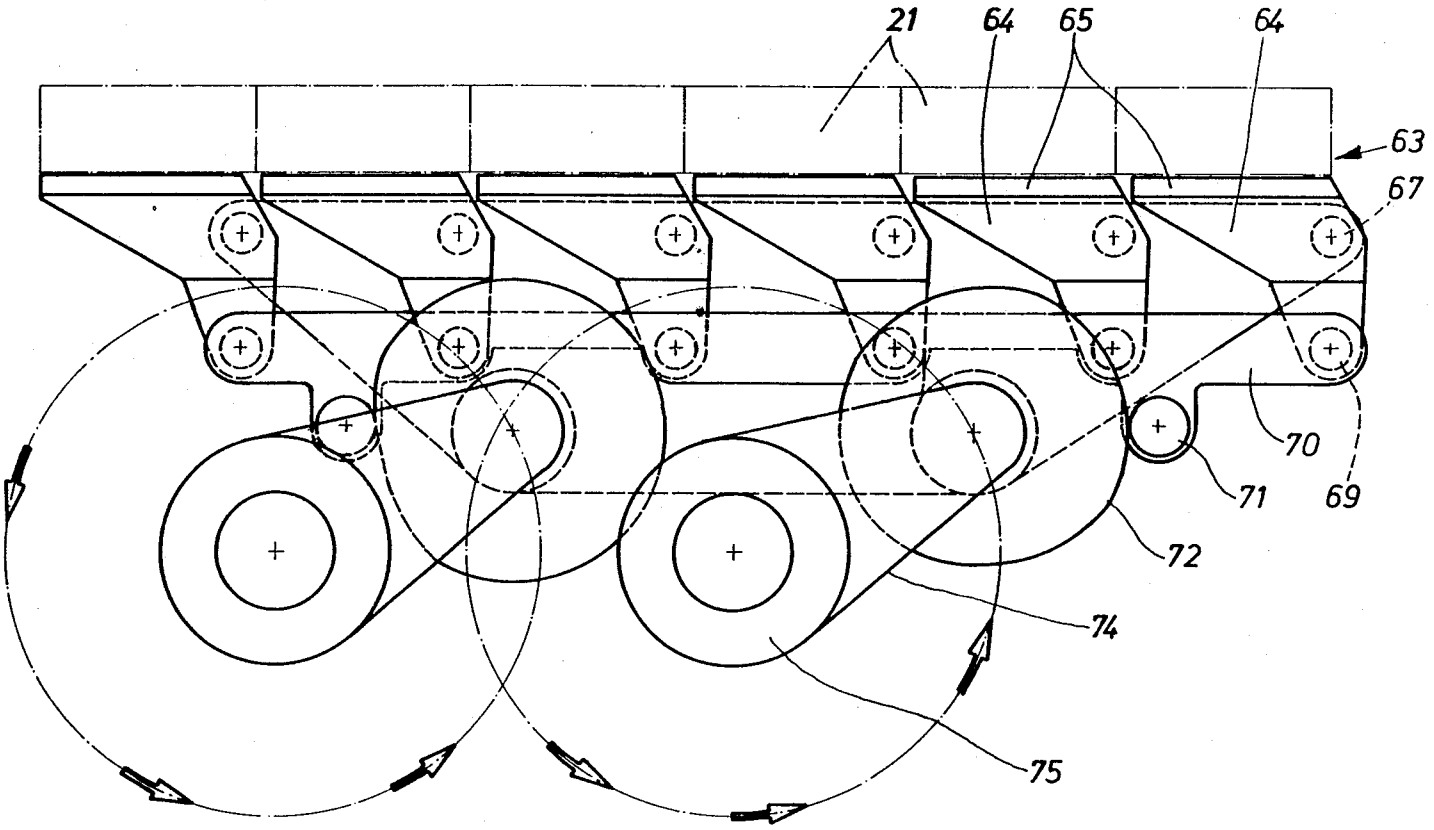
Figure 9:
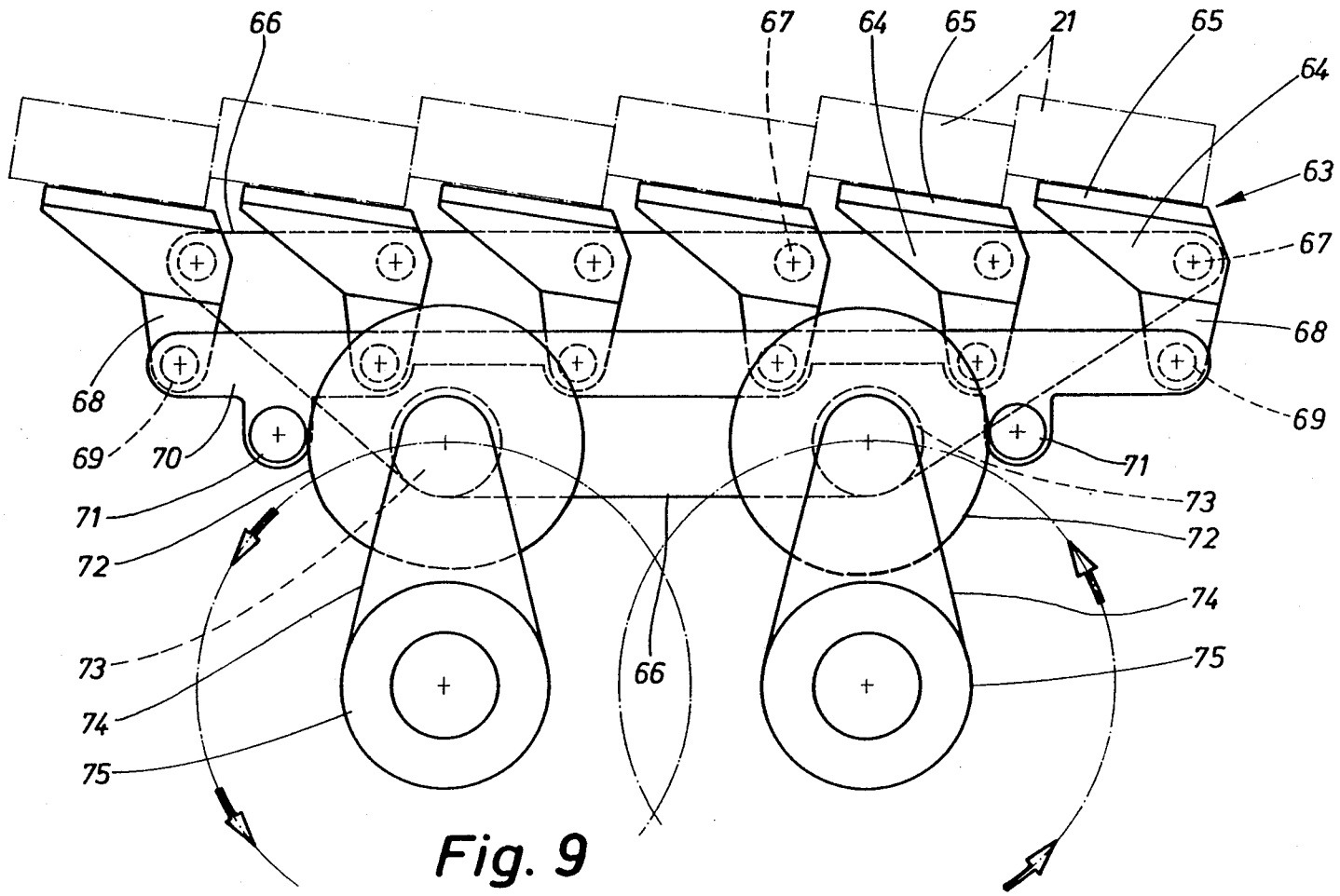
Figure 10:
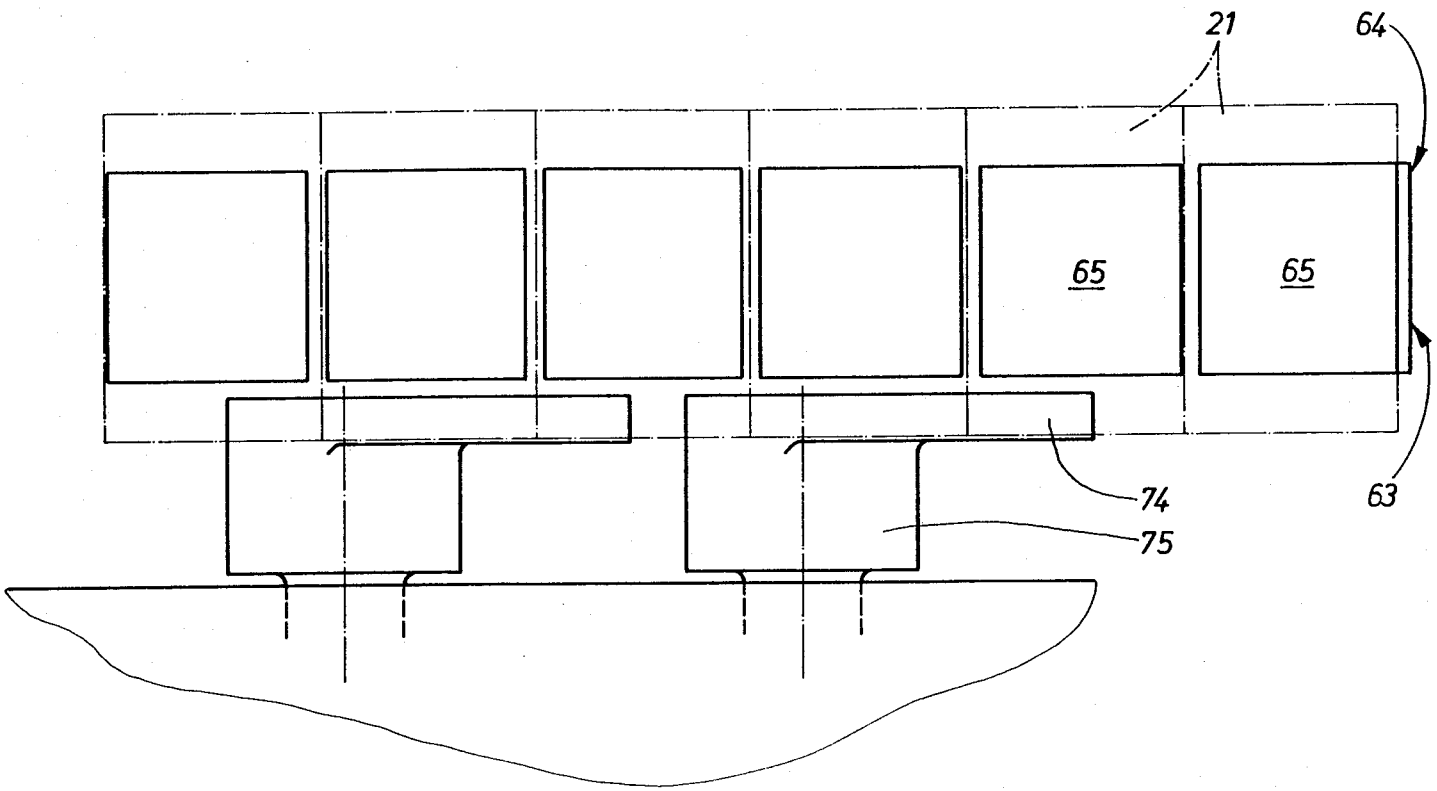
Figure 11:
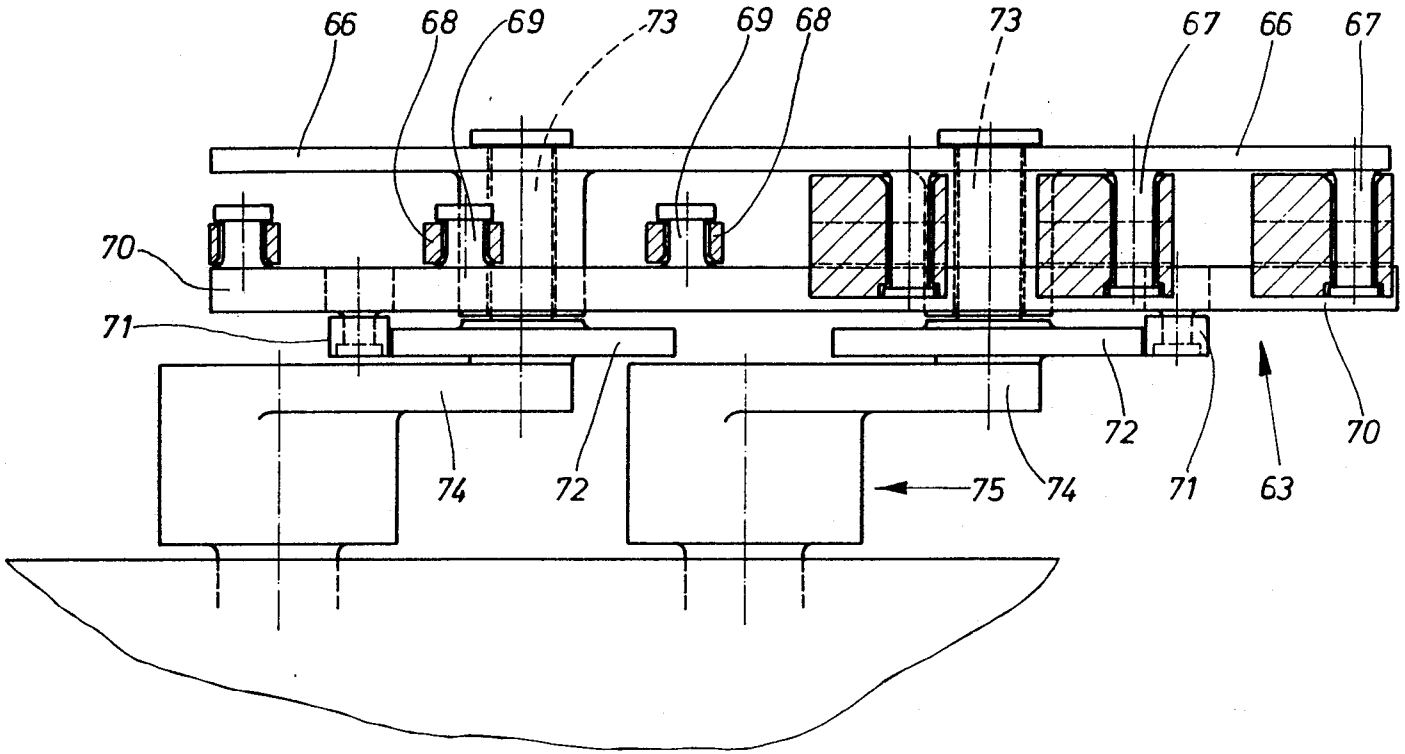
Figure 12:
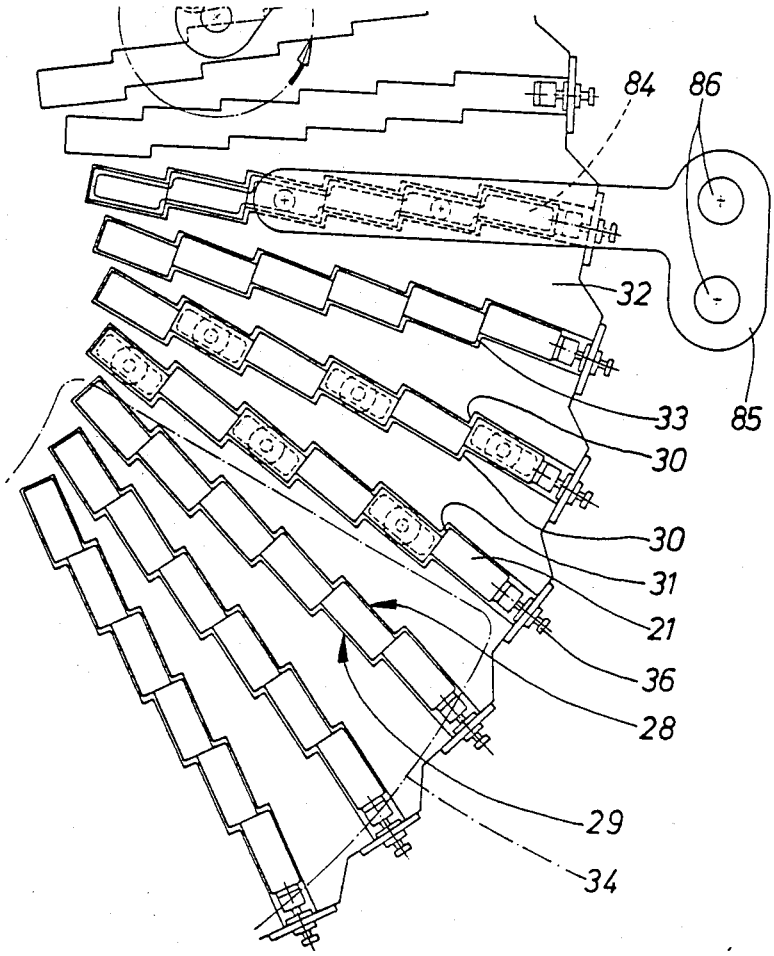
Figure 13:
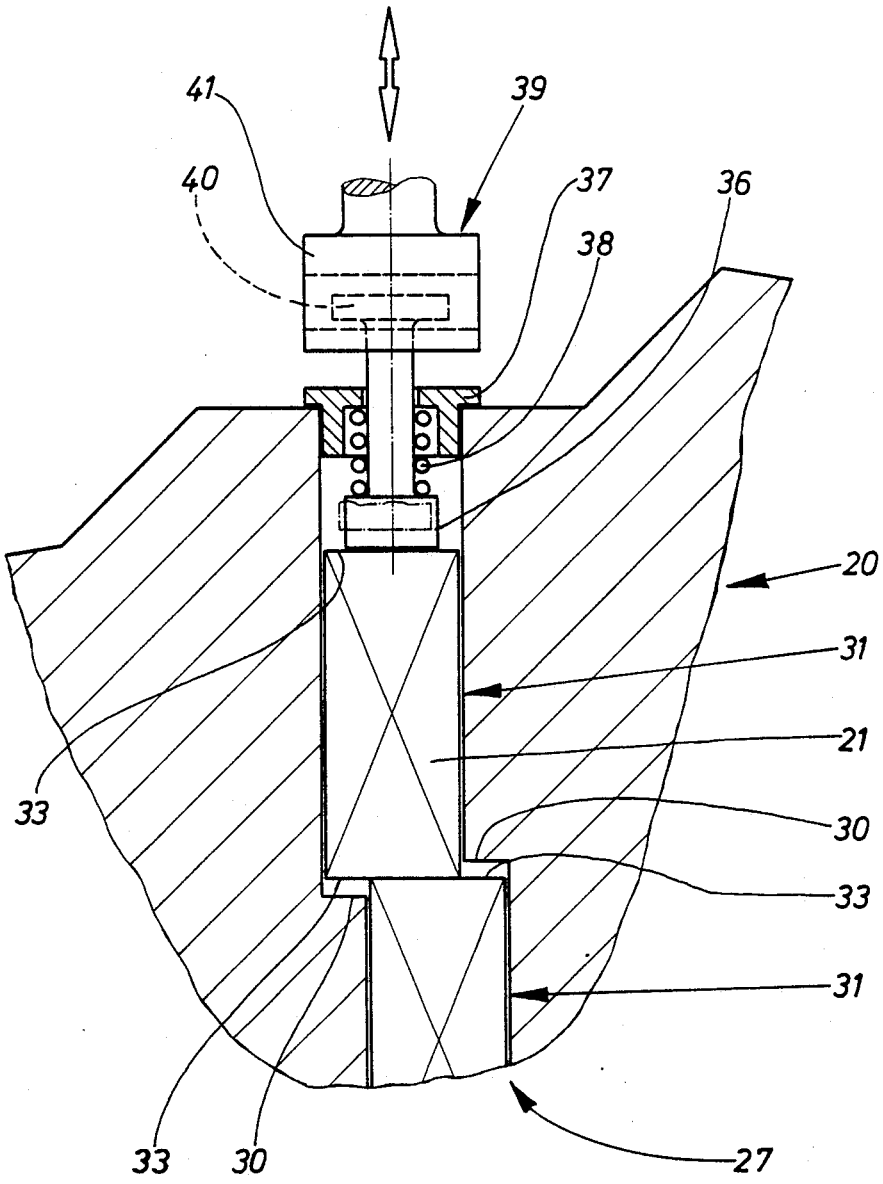

An exemplary embodiment of the apparatus according to the invention is explained in detail below with reference to an exemplary embodiment illustrated in the drawings. In these:

FIG. 1 shows a general diagrammatic view of the apparatus with a drying turret, FIG. 2 shows a side view of the drying turret with associated units and members, FIG. 3 shows, on an enlarged scale, a side view of a cut-out of the drying turret with members for delivering the packs, FIG. 4 shows a plan view of a detail in the region of a filling station, in particular a pack track with associated units, FIG. 5 shows, on an enlarged scale, a detail in the region of the filling station in the initial position, FIG. 6 shows the detail according to FIG. 5, with conveying members in a changed relative position, FIG. 7 shows the detail according to FIGS. 5 and 6, with conveying members in a relative position changed once again, FIG. 8 shows a side view of a pack platform as a detail taken from the region of the filling station, in the initial position, FIG. 9 shows the pack platform according to FIG. 8, with members in a changed relative position, FIG. 10 shows a plan view of the pack platform according to FIGS. 8 and 9, FIG. 11 shows, partially in section, details of the pack platform, in particular drive members for this, FIG. 12 shows a cut-out of the drying turret in the region of a pushing-out station, FIG. 13 shows, on an enlarged scale, a detail of the drying turret for fixing packs in pockets.

The apparatus illustrated in the drawings is used in conjunction with a packaging machine for cigarette packs, to be precise especially for so-called soft-cup packs. It is important to store the substantially finished packs temporarily so that glue spots in the region of folding tabs can set. During this phase, the packs consist of an inner wrapping (tin foil blank) and of a soft cup made of paper.

The essential component of the apparatus is a drying turret 20, to which the packs 21 coming from a packaging machine are delivered by conveying members. In the present exemplary embodiment, the packs 21 are transported by a conveying drum 22 and by a transfer turret 23 following the latter. The two conveying members are equipped, along the periphery, with conveying pockets 24 and 25 respectively, each intended for receiving a pack 21.

The packs 21 are thus delivered at a distance from one another to a feed station 26 of the drying turret 20 and are introduced into the drying turret 20 in groups, in the present case each comprising six packs 21.

The drying turret 20 driven intermittently in short indexing steps is equipped with a plurality of pockets 27, each intended for receiving a group of packs 21. The pockets 27 are distributed close to one another or at slight distances from one another over the entire drying turret 20, specifically in a relative position directed approximately radially. The deviation from the exact relative position by an amount corresponding to a small acute angle allows a more efficient utilization of space in the circular drying turret 20.

The pockets 27 are designed in a special way. Pocket side walls 28 and 29 extending in the axial direction of the drying turret 20 and in the longitudinal direction of the pockets 27 are made sawtooth-like to form projections or steps 30. The pocket side walls 28 and 29 designed in this way or their steps 30 define, within a pocket 27, chambers 31 each intended for receiving a pack. The relative position of the chambers 31 of a pocket 27 offset in a staggered manner results in a correspondingly offset arrangement of the packs 21 within a pocket of this type. Turret side walls 32 extending in the peripheral direction are provided with sawtooth-shaped recesses which are directed approximately radially and which limit the pockets 27 with the contours described.

The size of the chambers 31 is coordinated with the dimensions of the packs 21, these being arranged with their longitudinal extension axially parallel. In the longitudinal direction of the pockets 27, the chambers 31 are somewhat larger than the corresponding dimensions of the packs 21. This means that, when the pocket 27 is completely filled, the packs 21 are supported on one another by means of their narrow side faces 33, specifically offset in a staggered manner relative to one another according to the shape of the pocket 27. At the same time, the steps 30 of the chambers 31 are not touched by the packs 21 because these are supported solely on one another.

Interruptions can occur in the delivery of the packs 21 to the drying turret 20. But this should not change the indexing rate of the drying turret. This means that, under certain circumstances, pockets 27 are filled with a smaller number of packs 21. In this case, the packs located on the outside or on the inside in the radial direction are supported on a step 30 of the respective chamber 31. A close sequence of packs 21 is thereby maintained despite a smaller number in each pocket. Also, radial shifts of the packs 21 in the pocket 27 are prevented, irrespective of the number of packs.

Over a part region of the periphery of the drying turret 20, the pockets 27, which are accordingly open on both sides (as seen in the axial direction), are covered by a fixed guide wall 34 on each of the two sides of the drying turret 20. The guide walls 34 extend outside the region of the feed station 26 and outside an emptying station 35.

The packs 21 in the outer chamber 31 of the pockets 27 are subjected to an elastic holding force which, if applied, is transmitted to adjacent packs 21 in the same pocket 27. As shown in detail in FIG. 13, along the periphery of the drying turret 20 elastic press plungers 36 are mounted in the region of the pockets 27 in a pocket cover 37. The press plungers 36 are loaded towards a side face 33 of the pack 21 by a (helical) compression spring 38. In order to introduce the packs 21 into the pocket 27 and push them out of it, the press plungers 36 are temporarily pulled back from the pressing position shown, specifically by an actuating member 39 which takes effect in the region of the feed station 26 and in the region of the emptying station 35. A head 40 of the press plunger 36 is gripped by a claw 41 of the actuating member 39. As a result of a radial movement of the latter, the press plunger 36 is lifted off from the pack 21. The relative position of the actuating member 39 is such that the head 40 enters the claw 41 as a result of the rotation of the drying turret 20.

The feed station 26 is arranged in the upper region of the vertical drying turret 20 at a distance in front of the vertical mid-plane, as seen in the direction of rotation. The packs 21 are consequently introduced into the pockets 27 in an inclined conveying plane.

The transfer turret 23 delivers the packs 21 in succession to a straight pack conveyor 42 extending parallel to the pockets 27 and next to the drying turret 20. This pack conveyor 42 transports a group of (six) packs 21, if delivered, into a pushing-in position adjacent to a pocket 27 in the region of the feed station 26. The packs 21 of this group are first arranged close to one another in a straight line, are then moved int the staggered offset position and thereafter are pushed jointly into the pocket 27 or the associated chambers 31 of the latter.

In the entry region, that is to say in the region of the transfer turret 23, the pack conveyor 42 consists of two lateral belt conveyors 43. In the effective conveying region, these run on both sides of a conveying track for the packs 21, each over two deflecting rollers 45 and 45 located adjacent to one another. These are designed and arranged so that, when the radially outer deflecting roller 45 is in a specific position, a conveying strand 46 running parallel to the pack 21 is formed. This in each case grasps a pack 21 on end faces 27 located opposite one another.

The outer deflecting roller 45 is designed with two flattened portions 48. These ensure that, when the conveying strand 46 comes up against it, the conveying strand 46 of the belt conveyors 43 assumes a funnel-shaped converging position temporarily, in particular as a result of the rotation of the deflecting roller 45. During this phase, a following pack 21 is conveyed into the mouthpiece formed by the belt conveyors 43.

The conveying pockets 25 of the transfer turret 23 are of angular shape, in particular are open on the radially outer side located at the front in the direction of transport. It is thereby possible for the packs 21 to be transferred to the belt conveyors 43 and for these to take up the latter. At the same time, the conveying pockets 26 are momentarily moved into the region between the belt conveyors 43.

To guarantee the transfer of the packs 21 from the transfer turret 23 to the pack conveyor 42, on the side located opposite the transfer turret 23 is arranged a further conveying member for the packs, in particular a take-up turret 49. This is equipped, along the periphery, with specially designed take-up members 50 which run in synchronism with the conveying pockets 25, in such a way that, in interaction with these, the packs 21 are reliably transferred to the pack conveyor 42. For this purpose, the take-up members 50 are designed as pivotable forks, the prongs 51 of which penetrate into slot-shaped recesses 52 in the vertical rear wall 53 of the conveying pocket 25 and which, as a result of the movement characteristic, move the pack 21 out of the conveying pocket 25.

The conveying pockets 25 of the transfer turret 23 and the take-up members 50 of the take-up turret 49 are mounted movably and in the region of the transfer of the packs 21 to the pack conveyor 42 are controlled so that a translational movement in the conveying direction of the pack conveyor 42 is executed momentarily.

For this purpose, the take-up members 50 and, as illustrated, the conveying pockets 25 are mounted on pivoting arms 54, the pivoting movements of which are produced via links 55. The latter run by means of tracer rollers 56 on a cam disc 57. The shape of this is such that as a result of an appropriately oppositely directed pivoting movement of the pivoting arms 54 the above-described movement in a straight line takes place in the region of the take-over and transfer of packs 21.

The pack conveyor 42 is equipped with two supporting rails 58, 59 extending parallel to the direction of the pockets 27. These supporting rails 58, 59 are of angular cross-section, with a supporting leg 60 and a lateral guide leg 61. The latter are arranged at a distance from one another which corresponds to the height of the pack 21, so that the packs, if appropriately delivered, are conveyed onto the supporting rails 58 and 59 close to one another and in succession. Limit stops 62 of the supporting rails 58 and 59 determine the exact end position of the packs.

For introduction into an associated pocket 27, it is necessary to move the packs, aligned on the supporting rails 58, 59, into the staggered relative position corresponding to the contour of the pockets 27. For this purpose, in the region of the feed station 26 there is a pack platform 63 which has a number of pivoting stages 64 corresponding to the number of packs 21 in the group. In the initial position (FIG. 3), the pack platform 63 is located underneath the supporting rails 58, 59, the pivoting stages 64 or platforms 65 of the latter being aligned in one plane parallel to the packs 21 on the supporting rails 58, 59.

To position the packs 21 adjacent to the pocket 27 to be fed, the pack platform 63 is moved up to the underside of the packs 21, specifically in the region between the supporting rails 58, 59 or the supporting legs 60 of the latter. A platform 65 is moved up to the underside (front or rear side) of each pack and lifts this off from the supporting rails 58, 59. During the further movement of the pack platform 63 together with the packs 21, a relative adjustment of the pivoting stages 64 takes place, in such a way that their platforms 65 are offset relative to one another in a staggered manner and consequently the packs 21 assume a corresponding relative position in relation to one another (FIG. 9). At the same time, the pack platform 63 as a whole is shifted radially inwards and thereby passes from the initial position first offset outwards into an end position in which the individual packs 21 are aligned with the chambers 31 of the pockets 27.

For this purpose, in the present exemplary embodiment, the pack platform 63 consists of a (vertical) carrier plate 66, on which the individual pivoting stages 64 are mounted pivotably via journal bearings 67. A lower extension 68 of each pivoting stage 64 is connected to a common connecting rod 70 via a pivot bearing 69. The pivoting stages 64 thereby act like two-armed levers. The connecting rod 70 is supported via cam rollers 71 on (two) cam discs 72. These in turn are likewise mounted on the carrier plate 66 via main bearings 73. The main bearing 73 or its bearing journal is connected to a crank arm 74 of two fixedly mounted cranks 75.

As a result of the rotation of the cranks 75, the pack platform 63 as a whole is moved out of the initial position according to FIG. 3 up to the underside of the packs 21. Because of the resulting rotary movement of the cam discs 27 in relation to the cam rollers 71 of the connecting rod 70, the pivoting stages 64 are then tilted into the position according to FIG. 9. During the further rotation of the crank arms 74, the pivoting stages 64 return to the aligned position and the pack platform 63 as a whole returns to the initial position.

The packs 21 brought in this way into the aligned position adjacent to the pocket 27 to be filled are put down on intermediate carriers. In the present exemplary embodiment, these are, on the one hand, a supporting strip 76, on which one end region of the packs 21 rests, and, on the other hand, the topside of the guide leg 61 of appropriate size of the supporting rail 59 facing the drying turret 20. The supporting strip 76 and the guide leg 61 are aligned in one plane relative to the bearing surfaces. Furthermore, the supporting strip 76 and the guide legs 61 of the supporting rail 58 are made sawtooth-like on the top side according to the staggered relative position of the packs 21, in order to guarantee this relative position (FIG. 3).

After the group of packs 21 has been put down on the above-mentioned intermediate carriers, a pushing-in device 77 movable (axis-parallel) in the pushing-in direction is activated and pushes the group of packs 21 simultaneously into the pocket 27. The pushing-in device 27 is also made sawtooth-like to match the contour of the pocket 27.

For the exact alignment of the packs in this pushing-in position and during the pushing-in movement, a stop strip 78 is mounted fixedly on the top side. This likewise has a sawtooth-shaped profile on the side facing the packs 21. The stop strip 78 ensures that the packs 21 are aligned with the contour of the packet 27 in the pushing-in position.

In the present exemplary embodiment, the supporting strip 76 and pushing-in device 77 are connected to common supporting rods 81 via supporting arms 79, 80. The supporting rods 81 are mounted fixedly outside the region of the drying turret 20. Via separate sliding bodies 82 assigned respectively to the supporting arms 79 and 80, the supporting arms 79, 80 are mounted so as to be displaceable separately in an axis-parallel direction. Accordingly, via the supporting arms 79, 80 and the associated sliding bodies 82, the supporting strip 76 and the pushing-in device 77 can be moved in the way described.

The lateral guide walls 34 perform a function during the pushing of the packs 21 into the pockets 27 and thereafter. The dimensions of the pockets 27 in the axial direction of the drying turret 20 are such that the packs 21 project slightly from the pockets 27 on both sides. The guide walls 34 arranged on both sides serve as a stop for the exact alignment of the packs 21 in the pockets 27. These guide walls 34 are arranged so as to be movable in the axial direction. Whenever the drying turret 20 is stationary, the guide walls 34 are moved up to the end faces 47 of the packs for centering and shaping purposes. During the rotary movement, the guide walls 34 are lifted off from the packs 21 (see the position represented by dot-and-dash lines in FIGS. 5 to 7).

During the introduction of the packs 21 into the pocket 27, the press plunger 36 is lifted off, specifically by means of an actuating arm 83 equipped with a claw 41.

In the pocket 27, the packs 21 now pass through a drying zone of sufficient length in terms of time, up to the emptying station 35 adjacent to the feed station 26. Here, a pushing-out device 84 takes effect in the region of an approximately horizontally directed pocket 27, its slide plate having the contour of the pocket 27. The pushing-out device 84 is mounted on sliding rods 86 so as to be movable in the axial direction via a slide carrier 85. The pushed-out group of packs passes onto a horizontal discharge conveyor 87 (FIG. 1) which runs next to the drying turret 20.

The emptying station 35 is preceded by two test stations 88 and 89. In the region of these, the packs are tested by test members 90 which are moved up to the free end faces 47 of the packs 21. The arrangement is such that three packs 21 or chambers 31 are tested in each test station 88, 89.

We claim:

1. Apparatus for the storage of cigarette packs, especially for the setting of glue spots, including a rotating drying turret which has a plurality of pockets distributed along the periphery of the turret, each pocket intended for storing a plurality of packs, characterized in that each of the pockets (27) is elongated in an approximately radial direction of the circular turret and has in its longitudinal direction a plurality of radially spaced, circumferentially staggered steps (30) each capable of supporting a pack (21), wherein chambers (31), each for storing a pack (21), are defined in the pockets (27) by said steps (30) which are formed by a stepped design of pocket side walls (28, 29) extending in a direction parallel to a center axis of the circular turret.

2. Apparatus for the storage of cigarette packs, especially for the setting of glue spots, including a rotating drying turret which has a plurality of pockets distributed along the periphery of the turret, each pocket intended for storing a plurality of packs, characterized in that each of the pockets (27) is elongated in an approximately radial direction of the circular turret and has in its longitudinal direction a plurality of radially spaced, circumferentially staggered steps (30) each capable of supporting a pack (21), and in that the radially elongated pockets (27) are arranged slightly offset relative to the radial direction of the drying turret (20).

3. Apparatus for the storage of cigarette packs, especially for the setting of glue spots, including a rotating drying turret which has a plurality of pockets distributed along the periphery of the turret, each pocket intended for storing a plurality of packs, characterized in that each of the pockets (27) is elongated in an approximately radial direction of the circular turret and has in its longitudinal direction a plurality of radially spaced, circumferentially staggered steps (30) each capable of supporting a pack (21); and in that chambers (31), each of storing a pack (21), are defined in the pockets (27) by said steps (30) which are formed by a stepped design of pocket side walls (28, 29) extending in a direction parallel to a center axis of the circular turret, the dimension of the chambers (31) being such that each of the packs (21) within the pockets (27) is supported on an adjacent (21) and, when a pack is missing in an adjacent chamber (31), is supported on a step (30) defining the adjacent chamber (31).

4. Apparatus according to claim 3 claims, characterized in that the packs (21) can be pushed into the pockets (27) and out of them in an axis-parallel direction, in a group corresponding to the number of chambers (31) in a pocket (27) and aligned with the chambers (31).

5. Apparatus according to claim 4 characterized in that, in a feed station (26), a group of packs (21) can be conveyed into a position adjacent to a pocket (27) and aligned with the chambers (31) and can be pushed into the pocket (27) as a result of a joint transverse movement axis-parallel relative to the drying turret (20).

6. Apparatus according to claim 5 and characterized in that the packs (21) of a group, before being pushed into the pocket (27), can be moved into a staggered offset relative position corresponding to the arrangement of the chambers (31), by means of a pack platform (63) which is arranged next to the drying turret (20) and extends parallel to a pocket (27) to be fed and which has adjustable pivoting stages (64) each for receiving a pack (21).

7. Apparatus according to claim 6 characterized in that the packs (21) can be delivered close to one another in a row on a pack conveyor (42) arranged next to the drying turret (20) and parallel to the pocket (27) to be fed and can be lifted off from the pack conveyor (42) by means of the pack platform (63) and delivered to the pocket (27).

8. Apparatus according to claim 6 characterized in that the packs (21), arranged according to the formation of the pocket (27) can be put down on an intermediate holder next to the latter and can be jointly pushed into the pocket (27) by a pushing-in device (77).

9. Apparatus according to claim 8 characterized in that the intermediate holder consists of two lateral supporting members, of which a supporting strip (76) remote from the drying turret (20) can be moved in the axial direction out of an initial position and under the group of packs (21), the bearing surfaces being made sawtooth-like according to the relative position of the packs (21).

10. Apparatus according to claim 8 characterized in that the pivoting stages (64) of the pack platform (63) are designed as pivotable, two-armed levers and can be moved out of an aligned position into an offset staggered position by means of a common actuating member in the form of a connecting rod (70).

11. Apparatus according to claim 10 characterized in that the connecting rod (70), together with further members of the pack platform (63), is mounted on a carrier plate (66) which can be moved relative to the drying turret (20) out of an initial position for receiving the packs (21) into a position in which these are taken up by the intermediate holder

12. Apparatus according to claim 10 characterized in that the pack platform (63) can be moved by a crank mechanism (74, 75), and during a cycle of movement the pivoting stages (64) can be moved into an offset position and back into the aligned position as a result of the relative movement of the connecting rod (70).

13. Apparatus according to claim 5 characterized in that the feed station (26) is arranged relative to the drying turret (20) rotating in a vertical plane, in such a way that the packs (21) can be delivered to the pocket (27) on a pack track in the form of a pack conveyor (42), directed obliquely downwards.

14. Apparatus according to claim 13 characterized in that the packs (21) arriving in succession can be conveyed, by lateral feed bands, in the form of (belt conveyors 43), with a converging feed strand (46), onto fixed supporting rails (58, 59) for receiving the packs (21) arranged close to one another.

15. Apparatus according to claim 14 characterized in that, in the region of conveyance of the packs (21), each belt conveyor (43) is in each case guided over two deflecting rollers (44, 45) which are arranged at a distance from one another and of which the radially outer one has flattened portions (48) for forming a funnel-shaped run-in region of the belt conveyors (43).

16. Apparatus according to claim 13 characterized in that the pack conveyor (42) is preceded by a rotating transfer turret (23) with conveying pockets (25) for receiving a pack (21), the conveying pockets (25) being mounted pivotably and being controllable in such a way that, in the region of transfer to the pack conveyor (42), the packs momentarily execute a translational movement.

17. Apparatus according to claim 16 characterized in that a take-up turret (49) is arranged on the side of the pack conveyor (42) located opposite the transfer turret (23) and along a periphery has take-up members (50) for the packs (21), in the form of prongs (51) which penetrate into recesses (52) in a rear wall (53) of the conveying pockets (25) of the transfer turret (23).

18. Apparatus according to claim 14 characterized in that the packs (21) can be pushed from the belt conveyors (43) onto supporting rails (58, 59) which extend laterally next to the drying turret (20) and parallel to the pocket (27) to be fed.

19. Apparatus according to claim 5 characterized in that each pocket (27) of the drying turret (20) has assigned to it on the outer periphery a clamping member, in the form of a press plunger (36) which rests elastically against the radially outer pack (21) and which can be moved out of the clamping position by an actuating member (39) in the feed station (26) and in an emptying station (35).

20. Apparatus for the storage of cigarette packs, especially for the setting of glue spots, including a rotating drying turret which has a plurality of pockets distributed along the periphery of the turret, each pocket intended for storing a plurality of packs, characterized in that each of the pockets (27) is elongated in an approximately radial direction of the circular turret and has in its longitudinal direction a plurality of radially spaced, circumferentially staggered steps (30) each capable of supporting a pack (21); and in that the drying turret (20) with laterally open pockets (27) has assigned to it, on both sides of the drying turret (20), fixed guide walls (34) which can be lifted off from the drying turret (20) in the axial direction in synchronism with the intermittent rotary movements of the latter and which, in the position facing the drying turret (20), rest against the packs (21) projecting laterally from the pockets (27).

21. Apparatus according to claim 19 characterized in that, in the region of the emptying station (35), the packs (21) located in a horizontally directed pocket (27) can be pushed out of the pocket (27) in the axial direction by a pushing-out device (84) matching the contours of the latter, and onto a discharge conveyor (87) arranged adjacent to the drying turret (20).

* * * * *